US009140176B2

(12) United States Patent
Steiner et al.

(10) Patent No.: US 9,140,176 B2
(45) Date of Patent: Sep. 22, 2015

(54) COOLANT CIRCUIT WITH HEAD AND BLOCK COOLANT JACKETS CONNECTED IN SERIES

(71) Applicant: Ford Global Technologies, LLC, Dearborn, MI (US)

(72) Inventors: Bernd Steiner, Bergisch Gladbach (DE); Jan Mehring, Cologne (DE); Martin Wirth, Remscheid (DE); Bernd Brinkmann, Dormagen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/148,621

(22) Filed: Jan. 6, 2014

(65) Prior Publication Data

US 2014/0209046 A1 Jul. 31, 2014

(30) Foreign Application Priority Data

Jan. 29, 2013 (DE) ..... 10 2013 201 361

(51) Int. Cl.
*F01P 5/10* (2006.01)
*F01P 3/02* (2006.01)

(52) U.S. Cl.
CPC ... *F01P 5/10* (2013.01); *F01P 3/02* (2013.01); *F01P 2003/028* (2013.01); *F01P 2060/08* (2013.01); *F01P 2060/16* (2013.01)

(58) Field of Classification Search
CPC ..... F01P 3/02; F01P 5/10; F01P 3/12; F01P 2003/028
USPC ..... 123/41.01, 41.02, 41.72, 41.82 R, 123/41.313
See application file for complete search history.

(56) References Cited

U.S. PATENT DOCUMENTS

| | | | | |
|---|---|---|---|---|
| 2002/0152979 | A1* | 10/2002 | Hayashi et al. | 123/142.5 R |
| 2003/0111025 | A1* | 6/2003 | Kim | 123/41.72 |
| 2011/0296834 | A1* | 12/2011 | Kuhlbach et al. | 60/605.3 |

FOREIGN PATENT DOCUMENTS

| | | | |
|---|---|---|---|
| DE | 69707980 | T2 | 4/2002 |
| DE | 10219481 | A1 | 11/2003 |
| DE | 102010002082 | A1 | 8/2011 |
| EP | 0038556 | A1 | 4/1981 |
| EP | 0816651 | A1 * | 1/1998 |
| EP | 2128399 | A1 | 12/2009 |
| EP | 2562378 | A1 | 2/2013 |
| FR | 2594484 | A1 | 8/1987 |
| GB | 646201 | | 11/1950 |

* cited by examiner

*Primary Examiner* — Lindsay Low
*Assistant Examiner* — Kevin Lathers
(74) *Attorney, Agent, or Firm* — Julia Voutyras; Alleman Hall McCoy Russell & Tuttle LLP

(57) ABSTRACT

A method to operate a split coolant circuit of a combustion engine wherein a cylinder head coolant jacket and an engine block coolant jacket are provided in series with a pump delivering coolant to an inlet of the cylinder head coolant jacket without being directly connected to an inlet of the engine block coolant jacket. This allows for 100% of the pump flow rate to be delivered to the cylinder head coolant jacket before division of coolant flow occurs for various engine operating conditions.

6 Claims, 4 Drawing Sheets

COOLANT CIRCUIT WITH HEAD AND BLOCK COOLANT JACKETS CONNECTED IN SERIES

CROSS REFERENCE TO RELATED APPLICATIONS

The present application claims priority to German Patent Application No. 102013201361.2, filed on Jan. 29, 2013, the entire contents of which are hereby incorporated by reference for all purposes.

BACKGROUND/SUMMARY

A split coolant circuit as compared to conventional coolant circuit intends that the cylinder head is cooled during the warm-up phase of the combustion engine while the engine block is not initially cooled. This better enables the engine block temperature to be raised more quickly to the operating temperature. A split coolant circuit is one cooling circuit in which the coolant jacket of the cylinder head is separated by suitable means from the coolant jacket of the cylinder block.

In one approach, coolant is conveyed through a cylinder head cooling jacket by a first pump and through a cylinder block cooling jacket by a second pump. Both cooling jackets have no connection within the combustion engine but open on the outlet side into a main circulation conduit system. In another approach the distribution of the coolant flow between the cylinder head and the engine block coolant jacket is fixed based on a threshold temperature of 90° C.

Some of the problems recognized by the inventors with such set-ups come from having a coolant flow distribution such that a portion may be flowed to the cylinder block before the flow is directed to the cylinder head. Further utilizing multiple pumps and/or return passageways may be bulky, thereby reducing the engine's compactness and increasing the size and cost of the engine.

To at least partially address these problems one example includes a split coolant circuit of a combustion engine, comprising a cylinder head coolant jacket having an outlet housing into which an exhaust coolant jacket and an inlet coolant jacket of the cylinder head coolant jacket open, an engine block coolant jacket, a pump delivering coolant to an inlet of the cylinder head coolant jacket without being directly connected to an inlet of the engine block coolant jacket, a radiator, a control element, a heater, a block line, without a block control element, arranged directly on the outlet housing and leading to an inlet side of the engine block coolant jacket, coolant conducted in a same flow direction through the engine block coolant jacket as through the cylinder head coolant jacket, a block return line opening directly into the control element arranged on an outlet side of the engine block coolant jacket, a block shut-off valve arranged in the block return line, a heater line which leads to a cabin heater arranged on the control element, and a heater shut-off valve in a heater return line of the cabin heater. In this way the split coolant circuit comprises one pump reducing engine bulkiness.

In another example, a method for controlling the coolant flow in a split cooling system comprising flowing coolant from a pump to an inlet side of a cylinder head coolant jacket with <5% flowing to a turbocharger in a parallel line, without any connection between the pump and an inlet side of a block coolant jacket and then flowing coolant from the cylinder head coolant jacket to an outlet housing and a control element and then flowing a first coolant portion from the outlet housing through a block line to the inlet side of the block coolant jacket and then to the control element via a block return line such that coolant is directed in a same flow direction as the cylinder head coolant jacket and adjusting a magnitude of the first coolant portion based on an engine temperature via a block shut off valve. This may be done in a manner best suited for the engine operating conditions, providing the benefits of a split cooling circuit which may reduce fuel consumption, reduce emissions and increase the service life of the engine. Further, the coolant flows only through the cylinder head before distribution to other areas occur, better enabling cooling of the hottest engine parts during various engine operating conditions.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
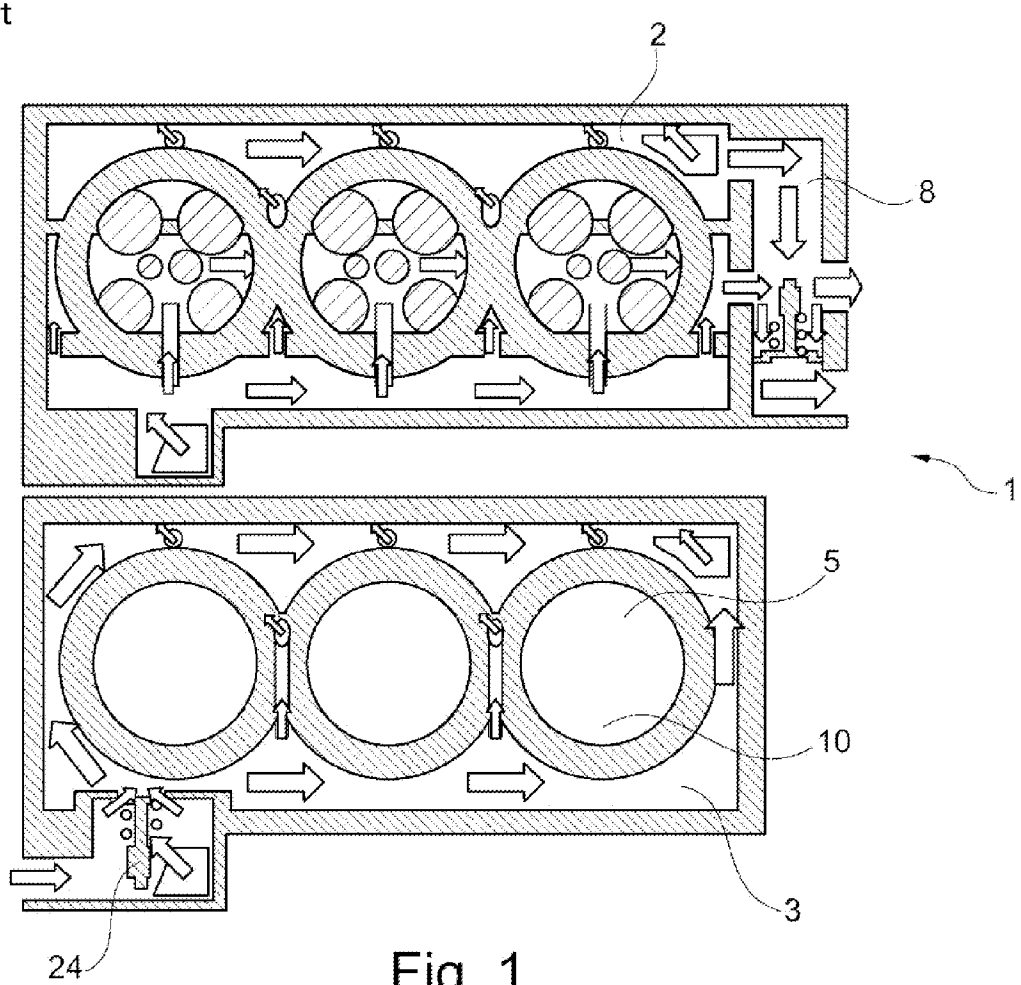
Fig. 1 Prior Art
FIG. 1 shows a split coolant circuit flow in the cylinder head coolant jacket and block coolant jacket according to the prior art

The invention relates to a split coolant circuit of a combustion engine according to the preamble of claim 1, wherein a cylinder head coolant jacket and an engine block coolant jacket are provided, wherein the split coolant circuit comprises at least one common pump, at least one radiator, at least one control element and at least one heater, and wherein the cylinder head coolant jacket has an outlet housing.

EP 0 038 556 B1, for example, describes a cooling system for a combustion engine. Coolant is conveyed through a cylinder head cooling jacket by means of a first pump. A second pump conveys coolant through the cylinder block coolant jacket. Both cooling jackets have no connection within the combustion engine, but open on the outlet side into a main circulation conduit system. A radiator bypass conduit system branches from this main circulation conduit system and leads to the cylinder head inlet of the head cooling jacket and to the cylinder block inlet of the cylinder block coolant jacket. A flow of coolant to the radiator is prevented, and a flow of coolant through the radiator bypass conduit system is permitted, by means of a control valve. A flow of coolant through the cylinder block coolant jacket is interrupted by means of a second control valve.

A flow of coolant of a coolant circuit advantageously flows separately, or at least predominantly separately, through the engine block and the cylinder head of the combustion engine. In this way the cylinder head, which is coupled thermally above all to the combustion chamber wall, to the intake air duct and to the exhaust gas discharge duct, and the engine block, which is coupled thermally above all to the friction areas, can be cooled in different ways. By means of this so-called split cooling system (divided coolant circuit) it is intended that the cylinder head is cooled during the warm-up phase of the combustion engine while the engine block is not initially to be cooled, so that the engine block can be raised more quickly to the required operating temperature; that is to say that a split cooling circuit should not be understood to mean two cooling circuits, but to mean one cooling circuit for a combustion engine in which the coolant jacket of the cylinder head is separated by suitable means from the coolant jacket of the cylinder block. However, with some designs small leakages from the cylinder head coolant jacket to the cylinder block coolant jacket may be provided, the quantities of leakage being so small that one can nevertheless speak of a split cooling circuit.

In the prior art the advantages and design concepts of divided cooling circuits (split cooling system) as compared to a conventional coolant circuit have long been known, as described, for example in DE 10 2010 002 082 and EP 2 128 399 of the applicant. It is disadvantageous that the distribution of the coolant flow between the cylinder head and the engine block water jacket is fixed in both phases (thermostat closed below 90° C., thermostat open above 90° C.), giving rise to unnecessarily high heat dissipation and little heating of the engine block and of the oil film along the cylinder liners. Attempts are made to prevent coolant from flowing through the cylinder block coolant jacket (the so-called "no-flow strategy" for the cylinder block coolant jacket) for as long as possible, in order to reduce frictional losses during the warm-up phase, especially after a cold start of the combustion engine. It is known, for example, to establish an internal connection between the block coolant jacket and the head coolant jacket, so that coolant vapor produced in the block coolant jacket during the no-flow period can be conducted into the head coolant jacket, preferably into the head coolant jacket on the inlet side. By diverting the hot gases or the hot vapor (which naturally collect in an upper region), the no-flow strategy for the cylinder block coolant jacket can be maintained longer, since coolant can flow through these regions in which hot vapors otherwise collect, so that thermal damage in these regions is advantageously avoided. It is also known that a bypass which bypasses the radiator or the main radiator branches from the thermostat, so that coolant can flow past the radiator, which therefore is not cooled unnecessarily, as is advantageous in the warm-up phase. However, installation space, which is extremely restricted in the engine compartment, must be taken up by the bypass.

In view of the above, it is the object of the invention to improve a split coolant circuit of the type mentioned in the introduction using simple means.

According to the invention, this object is achieved by a coolant circuit having the features of claim 1, wherein the common pump delivers coolant to an inlet of the cylinder head cooling jacket without connecting directly to an inlet of the block coolant jacket.

The pump has no direct connection to the block coolant jacket and is connected via its pump line only to the inlet of the cylinder head coolant jacket with a parallel line to the turbocharger which uses negligible coolant amounts. Nevertheless, a second pump is not needed to achieve a flow in the block coolant jacket. Rather, the coolant flow emerging from the head coolant jacket outlet enters the block coolant jacket via a block line, so that the pump common to both coolant jackets then generates the flow of coolant in the coolant jackets. The block line may be implemented as a separate, external line, although it is possible for the block line to be integrated in the cylinder head and/or the cylinder block, for example as a passage. The block coolant jacket only receives coolant after flowing through the head coolant jacket.

The cylinder head coolant jacket may have an inlet side and exhaust side with correspondingly separate coolant jackets, which may also include an integrated exhaust gas collector coolant jacket. The cooling jackets of the exhaust side and the inlet side may open directly into the outlet housing. It is advantageous if a block line, preferably without a control element, is arranged on the outlet housing and leads to an inlet side of the block coolant jacket, so that coolant can be directed in the same flow direction through the block coolant jacket as through the head coolant jacket. It is expedient if an outlet line or a return line is arranged on the outlet side of the block coolant jacket and opens directly into the control element, it being possible for a block shut-off valve, which can prevent a flow through the block coolant jacket, to be arranged in the outlet line. It is possible for a heater conduit leading to a cabin heater to be arranged on the control element, which conduit has a heater shut-off valve in its return line.

The coolant coming from the pump is advantageously conducted directly into the head cooling jacket, and may preferably be fed directly into the exhaust side, that is, into the exhaust-side coolant jacket of the head coolant jacket. If an integrated exhaust gas collector is provided, it is expedient to feed the coolant coming from the pump directly to this collector. The inlet side of the head coolant jacket may be connected to the block coolant jacket, so that coolant flows through said inlet side when it flows through the block coolant jacket. It is advantageous that the coolant from the cylinder head coolant jacket can be conducted directly into the block coolant jacket. In this case it is advantageously provided that a bypass also branches directly from the control element, so that the main radiator can be bypassed in order to avoid disadvantageous cooling of the coolant by the main radiator. A non-return valve is arranged in the bypass. These measures lead to higher material and oil temperatures, reducing friction and thermal losses. The advantageous implementation of the coolant circuit according to the invention combines the advantages of the split cooling circuit (rapid warm-up), fuel consumption and the production of harmful emissions being considerably reduced while the service life of the combustion engine is also lengthened or increased.

In the coolant circuit according to the invention, coolant advantageously flows in the same direction in both the separate coolant jackets. In the cylinder head coolant jacket the coolant flows from the inlet side to the outlet side, the coolant being supplied to the block coolant jacket on the side corresponding to the inlet side of the head coolant jacket. The coolant flow is naturally given by way of example. A flow in opposite directions in the cooling jackets is also possible. Self-evidently, the block coolant jacket has no flow contact with or coolant transfer to the cylinder head coolant jacket, although, of course, small leakage quantities cannot be ruled out, as mentioned in the introduction. This means, within the meaning of the invention, that coolant from the block coolant jacket does not directly enter the cylinder head coolant jacket, and that both coolant jackets are connected practically in series, with coolant flowing through them preferably in the same direction. For this purpose, however, the block line must pass from the outlet side of the cylinder head coolant jacket (in relation to the flow direction of the coolant) of the combustion engine to the inlet side of the combustion engine, that is, of the block coolant jacket, so that a flow in the opposite direction to (or in the same direction as) the flow in both coolant jackets is present at least in sections of the block line. Nevertheless, the block line is without a pump since it conveys coolant under high pressure, namely with the pump pressure, even if somewhat reduced, from the outlet housing in the direction of the block coolant inlet. In principle, however, the pressure losses are small.

It is advantageous within the meaning of the invention if a pump line connects the pump to the inlet side of the cylinder head coolant jacket. Only a single pump inlet, arranged on the head coolant jacket, preferably on the integrated exhaust gas collector coolant jacket, is therefore provided, a pump inlet to the block coolant jacket being dispensed with. Instead, in a preferred configuration, a simple connection, without a control element, is provided for the block line. This makes possible considerable space advantages regarding the possible path of the pump line to the head coolant jacket inlet. The coolant can therefore enter the outlet housing from the cylinder head coolant jacket.

It is advantageous if the heater line leading to the heater branches from the control element. The heater return line opens before or upstream of the pump into a main radiator return line which opens into the pump. However, the return line leading from the block coolant jacket does not open into the radiator return line, but suitably into the control element. A heat exchanger return line of a heat exchanger also opens into the control element, the feed line to the heat exchanger advantageously branching from the outlet housing. A reducing element is suitably arranged in the feed line to the heat exchanger. As already mentioned, the heater line now branches from the control element, although the main radiator line also starts from the control element. The main radiator line leads to the main radiator, the return line of which opens on the inlet side of the pump.

An advantage of the invention is that, during the warm-up phase but also during normal operation, that is, also after the warm-up phase, coolant always flows through the cylinder head coolant jacket at 100% of the rate delivered by the pump, the proportion delivered to a turbocharger (approximately 5%) being negligible. A distribution, that is, a supply of coolant to the block coolant jacket, and/or to the heat exchanger and/or to the cabin heater and/or to the main radiator, takes place only after the coolant has flowed through the cylinder head coolant jacket. This usefully has the result, however, that a lower temperature level is established in the cylinder head coolant jacket, the rate of flow through the block coolant jacket being adjustable in a factor-dependent manner in that the temperature of the coolant itself, and also the temperature of relevant block structures, is detected, that is, monitored. Thus, by means of the invention the object is achieved that coolant flows first, that is, before flowing through other components, through the hottest components of the combustion engine, namely the cylinder head, especially the exhaust side thereof which may have an integrated exhaust gas collector. In this way the overall flow resistance is reduced, permitting the use of an electric coolant pump. Of course, a no-flow strategy, in which coolant also does not flow through the head coolant jacket at least during a part of the warm-up phase, can also be implemented, coolant (100% of the amount of coolant delivered by the pump minus turbocharger proportion, see above) flowing through the head coolant jacket, and therefore also through the coolant jacket of the integrated exhaust gas collector, upon completion of the relevant partial phase. With the no-flow strategy, temperature measurements and monitoring can, of course, also be carried out in order to allow the coolant also to flow in the block coolant circuit at the appropriate time. In addition, with the invention the previously usual block thermostat becomes redundant. The block shut-off valve on the outlet side is advantageously arranged in the return line to the control element. The block shut-off valve may also be arranged in the block line, although a block shut-off valve may also be dispensed with.

The shut-off valves (block shut-off valve and heater shut-off valve) may be switched electronically by means of a control device; the corresponding switching operations may also be generated in a central control unit.

The control element on or in the outlet housing may be in the form of a thermostat.

Figure 2:
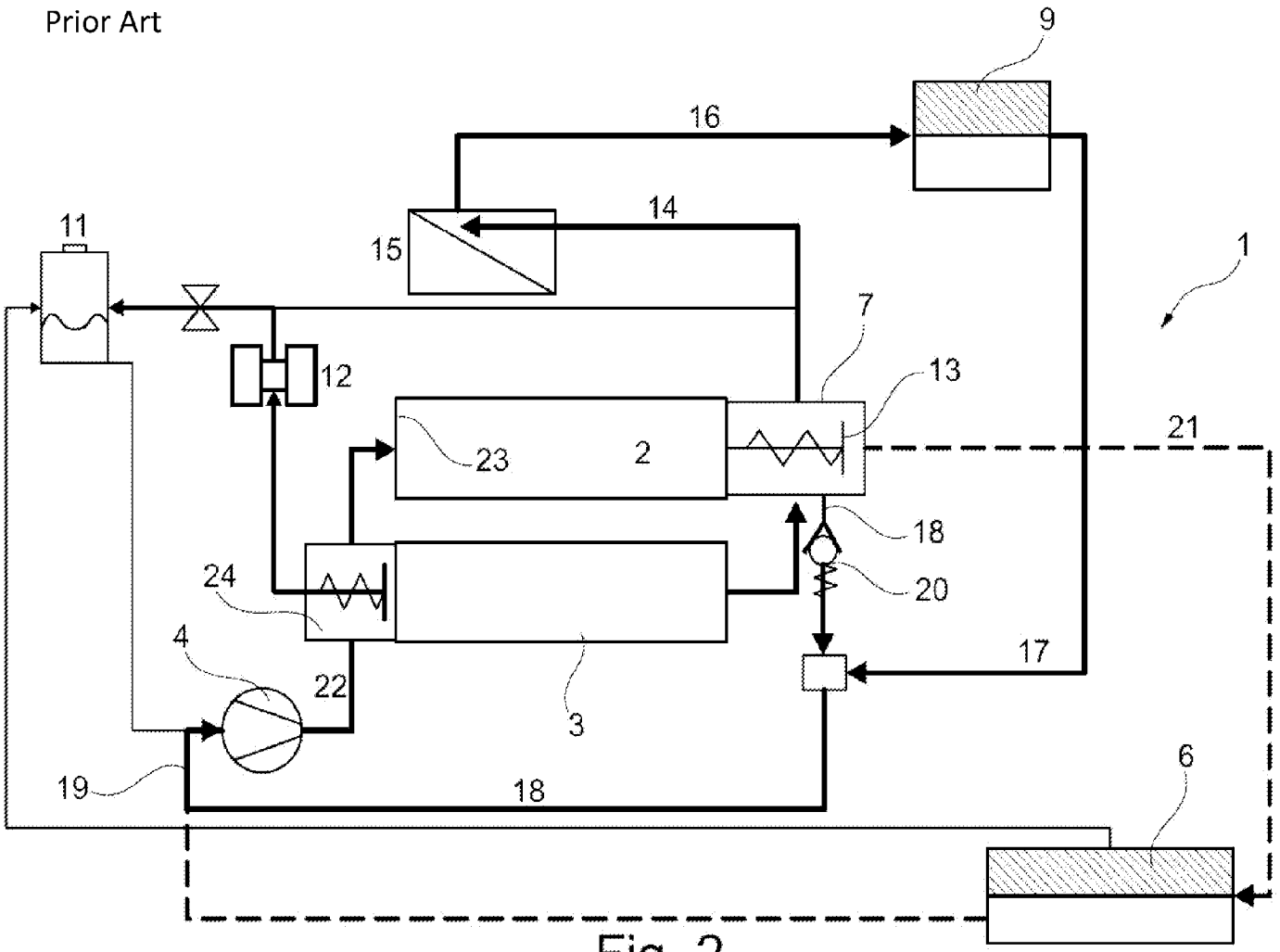
Fig. 2 Prior Art
FIG. 2 shows a schematic diagram of a coolant circuit according to the prior art.

Turning to FIGS. 1&2, a split coolant circuit 1 according to the prior art is represented. The split coolant circuit 1 comprises a cylinder head coolant jacket 2 and a block coolant jacket 3, a pump 4, a main radiator 6, a control element 7, a coolant outlet housing 8, a block thermostat 24, and a heater 9. In addition, the split coolant circuit 1 may include a degassing device 11 and a coolant line to a turbocharger 12. The combustion engine has an inlet side 5 and an exhaust side 10.

The head coolant jacket 2 is separated from the block coolant jacket 3, so that a split coolant circuit 1 in which a coolant circulates is present. The flow direction of the coolant is indicated by corresponding arrows.

The control element 7 arranged on the outlet housing 8 is formed by a thermostat 13. A feed line 14 leads from the thermostat 13 to a heat exchanger 15, which is in the form of an oil/water heat exchanger. A connecting line 16 leads from the heat exchanger 15 to a cabin heater 9, the heater return line 17 of which opens into a bypass 18. The bypass 18 starts from the control element 7 and opens into a second radiator return line 19. A non-return valve 20 is arranged in the bypass 18. The first radiator line 21 leads from the control element 7 to the main radiator 6, the second radiator return line 19 of which opens into the pump 4.

A pump line 22 connects the pump 4 to the inlet side 23 of the head coolant jacket 2, and also to the block coolant jacket 3, in which a block thermostat 24 is arranged on the inlet side. If the block thermostat 24 is closed, the coolant can reach the outlet housing 8 from the head coolant jacket 2, a flow through the block coolant jacket 3 being prevented. If the block thermostat 24 is open, a division of the coolant flow occurs with a portion flowing through the head coolant jacket 2 and another portion flowing through the block coolant jacket 3 with both flows reaching the outlet housing 8. In other words, the inlet-side coolant flow is divided and is supplied on the one hand to the head coolant jacket 2 but also to the block coolant jacket 3. From the outlet housing 8 the coolant reaches the heat exchanger 15 and from there the heater 9 and, further downstream of the non-return valve 20, the bypass 18.

Figure 3:
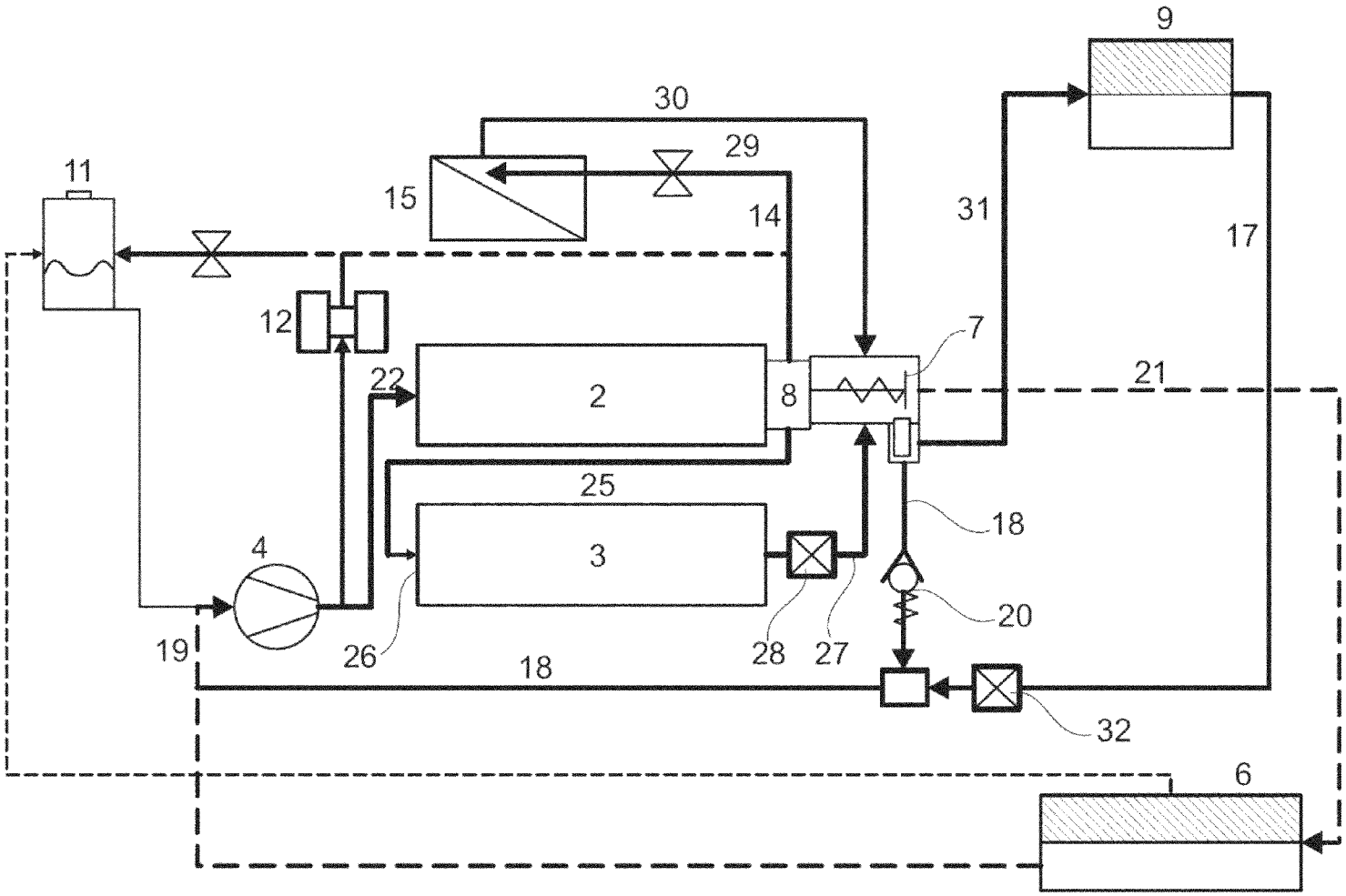
FIG. 3 shows a schematic diagram of a coolant circuit with the cylinder head coolant jacket and block coolant jacket arranged in series.

Turning to FIG. 3, the coolant is provided to the cylinder head coolant jacket 2 from the pump 4 through pump line 22 at 100% of the rate delivered by the pump before division of the coolant flow occurs, the proportion delivered to a turbocharger 12 (approximately 5%) being negligible. In FIG. 3 a pump inlet to the block coolant jacket 3 and a block thermostat are omitted, therefore pump 4 is without a direct connection to the block coolant jacket 3.

The cylinder head jacket 2 may comprise an integrated exhaust gas collector coolant jacket (not shown). Further, the pump 4 may be connected directly to the inlet of the exhaust gas collector jacket. The coolant flows through only the cylinder head jacket 2 with the flow volume and pressure delivered by pump 4 to the outlet housing 8.

From the outlet housing 8 the flow may be directed to a block line 25 to an inlet side 26 of the block coolant jacket 3. The block line 25 only receives coolant after it has passed through the cylinder head jacket. The block line 25 may be arranged so that the coolant flow direction in the block is in the same direction as the cylinder head. In another example, it may be arranged so that the coolant flow direction in the block is in the opposite direction as the cylinder head. From the block coolant jacket 3 a block return line 27 leads to the control element 7 and comprises a block shut off valve 28. A variable adjustment valve may also be used. Further, the valve 28 may also be arranged in the block line 25 or may be omitted. The valve 28 may prevent or reduce the flow of coolant through the block cylinder coolant jacket based on engine operating parameters.

From the outlet housing 8 the flow may be directed to a heat exchanger 15 which is separated from the heater. The coolant flows from the outlet housing 8 through the feed line 14 through a reducing element 29 arranged on 14 into the heat exchanger 15. A heat exchanger return line 30 leads from the heat exchanger 15 to the control element 7. The reducing element 29 may reduce the flow volume of the coolant. The heat exchanger 15, for example, may be an oil/coolant heat exchanger with known characteristics.

The control element 7 may be located, for example, on the outlet housing 8 or in the outlet housing 8. Further the control element 7 may be a thermostat.

A heater line 31 leads from the control element 7 to the heater 9, the heater return line 17 of which opens into the bypass 18 downstream of the non-return valve 20 and which further opens into the second radiator return line 19. A heater shut-off valve 32 is arranged in the heater return line 17 upstream of the junction with bypass 18. Further the heater shut-off valve may be a variable adjustment valve.

A first radiator return line 21 leads from the control element 7 to the radiator 6 which further opens into the second radiator return line 19.

A bypass line 18 leads from the control element 7 and encompasses a non-return valve 20 which further opens into the second radiator return line 19. The bypass line 18 allows for coolant to flow past the radiator, for example during the warm-up phase, therefore it is not cooled unnecessarily.

In FIG. 3, a division of the coolant flow takes place only downstream of the head coolant jacket 2. Thus, the block coolant jacket 3 can be operated with a very flexible warm-up phase, which has an especially favorable effect on fuel consumption but also on reduced frictional losses. If the block coolant jacket 3 is open, coolant, although drawn from the outlet side of the combustion engine, that is, from the outlet housing 8, flows through the block coolant jacket 3, in the same direction (by way of example) as the flow direction in the head coolant jacket 2, although the coolant in the block line 25 flows, at least in sections, in the opposite direction, from the outlet side to the inlet side.

Figure 4:
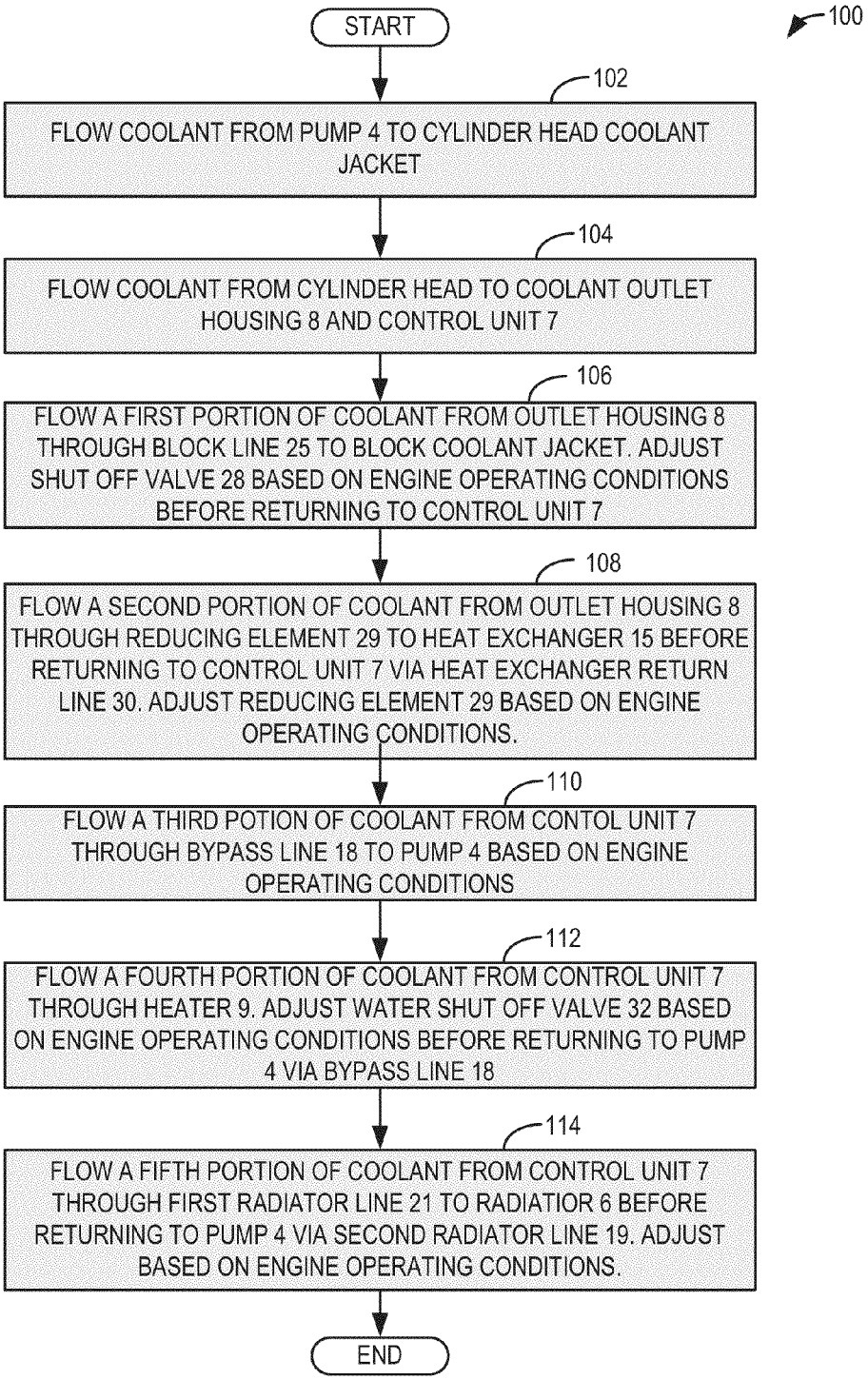
FIG. 4 schematically shows one example method for operating coolant flow.

The flow rate of coolant through the block coolant jacket 3 may also be adjusted in a factor-dependent manner, so that it reacts directly to different engine operating states, while the coolant volume and pressure delivered by the pump 4 always flow through the head coolant jacket 2, although the negligible proportion of coolant delivered to the turbocharger 12 (approximately 5%) should be subtracted. This is expedient because, in particular, the exhaust side of the cylinder head is the hottest area of the combustion engine, which requires special cooling. As a result of the high flow throughput within the head coolant jacket 2, therefore, a correspondingly reduced temperature level is established in the head coolant jacket. Turning to FIG. 4, shows a method 100 for operation of a cooling system in an engine. The method 100 may be implemented by the engine and cooling system with regard to FIG. 3 or may be implemented by other suitable engines and cooling systems.

At 102, the method includes flowing the coolant from pump 4 to the cylinder head coolant jacket 2 with a negligible (<5%) amount of coolant flowing to the turbocharger 12 via pump line 22. It will be appreciated that this allows the coolant to flow only to the cylinder head coolant jacket 2 with no division of the flow. This flow may be substantially 100%, minus the flow to the turbocharger 12. The pump line 22 may be connected directly to the cylinder head inlet or exhaust gas collector inlet if one is integrated.

At 104, the coolant flows through the cylinder head cooling jacket 2 to the coolant outlet housing 8 and control element 7, which may be on the outlet housing 8 or within the outlet housing 8.

At 106, a first portion of the coolant may be flowed from outlet housing 8 through block line 25 to the block coolant jacket 3, return line 27 and then control unit 7. The second portion of the coolant flows only after it has passed through the cylinder head meaning the block coolant jacket only receives coolant after it has passed through the cylinder head coolant jacket. The method further allows for the adjustment of shut-off valve 28 on return line 27 based on engine operating parameters. For example, during the warm-up phase of the engine the shut-off valve 28 may be closed to allow no coolant flow through the block coolant jacket 3. This better enables the engine to heat up more quickly. Further, the shut-off valve may be a variable adjustment valve to allow for the control of the flow rate through the engine block coolant jacket 3 based on engine operating parameters.

At 108, a second portion of coolant may be flowed to the heat exchanger 15 via feed line 14 which comprises a reducing element 29. The first portion of the coolant flows only after it has passed through the cylinder head. The method further allows for adjustment of the reducing element 29 based on engine operating parameters, for example, the engine operating temperature. The first portion leaves the heat exchanger 15, flows through heat exchanger return line 30, and then enters control unit 7.

The coolant from 104, 106 and/or 108 of the method flows into control element 7. To complete the coolant circuit, the coolant may be flowed in one or more of the manners described below in 110, 112, and/or 112.

At 110, a third portion of the coolant may be flowed from control unit 7 through bypass line 18 to pump 4 through a non-return valve 20. The method further allows for adjustment of the third portion due to engine operating parameters. For example, during the warm-up phase of the engine it may be beneficial to flow the coolant through the bypass 18 instead of the first radiator line 21 in order to bypass the radiator 6.

At 112, a fourth portion of the coolant may be flowed from control unit 7 through heater 9 via heater line 31 to heater return line 17 that joins bypass line 18 downstream of non-return valve 20 before returning to pump 4. The method further allows for adjustment of water shut-off valve 32 on water return line 17. For example, during the warm-up phase of the engine the shut-off valve may be closed to allow no coolant flow through the heater 9. Further, the shut-off valve may be a variable adjustment valve to allow for the control of the flow rate through the heater 9 based on engine operating parameters.

At 114, a fifth portion of coolant may be flowed from control unit 7 through first radiator line 21 to radiator 6 before returning to pump 4 via second radiator line 19. The method further allows for adjustment of the fifth portion from the control unit 7. For example, after the warm-up phase it may be beneficial to increase coolant flow to the radiator to keep the engine operating temperature below a maximum threshold.

It will be appreciated by those skilled in the art that although the invention has been described by way of example with reference to one or more embodiments it is not limited to the disclosed embodiments and that alternative embodiments could be constructed without departing from the scope of the invention as defined by the appended claims.

The invention claimed is:

1. A method comprising:

flowing coolant from a pump to an inlet side of a cylinder head coolant jacket with <5% flowing to a turbocharger in a parallel line, where the cylinder head coolant jacket is connected in series with an inlet side of a block coolant jacket;

flowing coolant from the cylinder head coolant jacket to an outlet housing and a control element;

flowing a first coolant portion from the outlet housing through a block line to the inlet side of the block coolant jacket and then to the control element via a block return line such that coolant is directed in a same flow direction as the cylinder head coolant jacket; and adjusting a magnitude of the first coolant portion based on an engine temperature via a block shut off valve.

2. The method of claim 1 where adjusting the flow of the first coolant portion is also based on an engine load.

3. The method of claim 1 further comprising;

flowing a second coolant portion from the outlet housing through a heat exchanger to the control element via a heat exchanger return line;

adjusting a magnitude of the second coolant portion based on the engine temperature via a reducing element.

4. The method of claim 1 further comprising;

flowing a third coolant portion from the control element through a bypass to a second radiator line to the pump; and adjusting a magnitude of the third coolant portion based on the engine temperature via a non-return valve.

5. The method of claim 1 further comprising;

flowing a fourth coolant portion from the control element through a heater to a bypass downstream of a non-return valve arranged in the bypass to a second radiator line to the pump;

adjusting a magnitude of the fourth coolant portion based on the engine temperature via a heater shut-off valve.

6. The method of claim 1 further comprising;

flowing a fifth coolant portion from the control element through a first radiator line through a radiator to a second radiator line to the pump; and adjusting a magnitude of the fifth coolant portion based on the engine temperature via the control element.

* * * * *